US006547032B2

(12) United States Patent
Yoon et al.

(10) Patent No.: US 6,547,032 B2
(45) Date of Patent: Apr. 15, 2003

(54) SUCTION MUFFLER OF RECIPROCATING COMPRESSOR

(75) Inventors: Sang-Heon Yoon, Seoul (KR); In-Seop Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 93 days.

(21) Appl. No.: 09/753,661

(22) Filed: Jan. 4, 2001

(65) Prior Publication Data

US 2002/0017425 A1 Feb. 14, 2002

(30) Foreign Application Priority Data

Jul. 13, 2000 (KR) ..... 2000/40218

(51) Int. Cl.[7] ..... F02M 25/00

(52) U.S. Cl. ..... 181/229; 181/403; 181/207; 417/312

(58) Field of Search ..... 181/202, 207, 181/208, 229, 265, 255, 269, 272, 403; 417/312, 902; 138/30, 39, 43

(56) References Cited

U.S. PATENT DOCUMENTS 4,105,090 A * 8/1978 Tachibana et al. ..... 181/265
5,249,919 A * 10/1993 Sishtla et al. ..... 181/202
5,635,687 A * 6/1997 Biscaldi ..... 181/272
6,390,132 B1 * 5/2002 Johnson et al. ..... 138/30

* cited by examiner

*Primary Examiner*—Khanh Dang

(57) ABSTRACT

Disclosed is a suction muffler including a muffler inlet, a muffler outlet communicating with the muffler inlet, a plurality of reservoirs defined between the muffler inlet and the muffler outlet, a plurality of small-diameter tubes adapted to allow the reservoirs to communicate sequentially with one another, and a vibration absorbing member installed on an inner wall surface of each of the reservoirs at a region where a flow of fluid sucked at a high velocity into the muffler inlet and forced to flow to the muffler outlet via the small-diameter tubes is struck against the inner wall surface, the vibration absorbing member serving to absorb vibrations generated due to pulsations of the fluid flow resulting from the striking of the fluid flow against the inner wall surface, thereby attenuating flow noises resulting from the vibrations. This suction muffler obtains an effect capable of offsetting noises generated when refrigerant gas flows are struck against inner constructions of the suction muffler.

7 Claims, 7 Drawing Sheets

SUCTION MUFFLER OF RECIPROCATING COMPRESSOR

BACKGROUND OF THE INVENTION

1. Field of the Invention

The present invention relates to a suction muffler used in a reciprocating compressor, and more particularly to a suction muffler of a reciprocating compressor capable of attenuating pulsating flows generated due to refrigerant gas sucked into the suction muffler, thereby reducing noises.

2. Description of the Related Art

Generally, a muffler applied to reciprocating compressors is installed at the fluid suction section or fluid discharge section of a reciprocating compressor to attenuate suction noises generated during a fluid sucking operation of the compressor or discharge noises generated during a fluid discharging operation of the compressor. The muffler installed at the fluid suction section of the compressor is called a "suction muffler", and the muffler installed at the fluid discharge section of the compressor is called a "discharge muffler".

Such suction and discharge mufflers serve to attenuate a pulsation phenomenon periodically generated during repeated fluid suction and discharge operations of a compressor, to which those mufflers are applied, thereby allowing the compressor to smoothly suck and discharge fluid. These mufflers also serve to shield impact noises generated in opening and closing operations of a valve and noises resulting from flowing of fluid so that those noise cannot be externally transmitted from the compressor, thereby reducing the level of noises outputted from the compressor.

FIG. 1 is a sectional view illustrating an example of a reciprocating compressor respectively provided with conventional mufflers at suction and discharge sections thereof.

As shown in FIG. 1, the reciprocating compressor includes a casing 1 filled with a desired amount of oil, an electric motor mechanism installed in a lower portion of the casing 1 in the interior of the casing 1 and adapted to generate a drive force in response to electric power externally applied thereto, and a compression mechanism installed at an upper portion of the casing 1 in the interior of the casing 1 and adapted to receive the drive force from the electric motor mechanism so as to conduct gas sucking and compressing operations.

The compression mechanism includes a frame 2 fixedly mounted to the casing 1 in a lateral direction in the interior of the casing 1, a cylinder 3 fixedly mounted to a portion of the frame 2, and a drive shaft 5 extending vertically through a central portion of the frame 2 while being fitted in a rotor 4B included in the electric motor mechanism so that it is coupled to the rotor 4B. The drive shaft 5 is provided at an upper end thereof with an eccentric portion. The compression mechanism also includes a connecting rod 6 coupled to the eccentric portion of the drive shaft 5 and adapted to convert a rotating movement into a reciprocating movement, a piston 7 connected to the connecting rod 6 and slidably received in the cylinder 3 in such a fashion that it reciprocates in the cylinder 3, a valve assembly 8 coupled to the cylinder 3 and adapted to control suction and discharge of refrigerant gas, and a head cover 9 coupled to the valve assembly 8 and defined with a desired discharge space DS. The compression mechanism further includes a suction muffler 10 coupled to a portion of the head cover 9 in such a fashion that it communicates with a suction section of the valve assembly 8, and a discharge muffler DM mounted to the cylinder 3 in such a fashion that it communicates with a discharge section of the valve assembly 8.

As shown in FIG. 2, the suction muffler 10 includes a muffler inlet 11 communicating directly with a refrigerant suction line SP extending through the casing 1 or arranged in the interior of the casing 1, and a muffler outlet 12 communicating with the suction section of the valve assembly 8 to allow refrigerant gas introduced into the muffler inlet 11 to be guided to a compression chamber defined in the cylinder 3. The suction muffler 10 also includes a pair of partition plates, that is, a first partition plate 13 and a second partition plate 14, adapted to partition the inner volume of the suction muffler 10 into three reservoirs in the form of expansion chambers, that is, a first reservoir S1, a second reservoir S2, and a third reservoir S3, a first small-diameter tube 15 extending vertically through the first partition plate 13 and serving to allow the first and second reservoirs S1 and S2 to communicate with each other, a second small-diameter tube 16 extending through the first and second partition plates 13 and 14 and serving to allow the second reservoir S2 to communicate directly with the muffler outlet 12. The suction muffler 10 further includes a resonant aperture 17 formed at an intermediate wall portion of the second small-diameter tube 16 arranged in the third reservoir S3 and adapted to allow the third reservoir S3 to communicate with the muffler outlet 12 so that it constitutes a helmholtz resonator, together with the third reservoir S3.

The first and second small-diameter tubes 15 and 16 have a simple cylindrical shape.

In FIGS. 1 and 2, the reference numeral or character 4A denotes a stator, 18 an oil discharge port, C a support spring, O an oil feeder, and SP a suction tube.

Now, an operation of the reciprocating compressor provided with the above mentioned conventional mufflers will be described.

When the rotor 4B is rotated by a mutual electromagnetic force generated between the stator 4A and the rotor 4B in response to electric power applied to the electric motor mechanism, the drive shaft 5 rotates along with the rotor 4B. The rotation of the drive shaft 5 is converted into straight reciprocating movements by the connecting rod 6 coupled to the eccentric portion of the drive shaft 5. The reciprocating movements is transmitted to the piston 7 which, in turn, reciprocates in the interior of the cylinder 3 to suck and compress refrigerant gas and to discharge the compressed refrigerant gas. Pressure pulsations and noises, which may be generated during the above mentioned operations of the piston 7, flow in a direction opposite to the flowing direction of the refrigerant gas so that they are attenuated by the suction muffler 10.

The procedure for attenuating the pressure pulsations and flowing noise by the conventional mufflers will be described in more detail.

During a suction stroke of the piston 7 from an upper dead point to a lower dead point, refrigerant gas filled in the second reservoir S2 is forced to be sucked into the compression chamber of the cylinder 3 via the muffler outlet 12 while opening a suction valve (not shown). Simultaneously, new refrigerant gas is introduced into the second reservoir S2 via the muffler inlet 11, first reservoir S1 and first small-diameter tube 15.

On the other hand, during a compression stroke of the piston 7 from the lower dead point to the upper dead point, the suction valve (not shown) is closed. In this state, a discharge valve (not shown) is simultaneously opened. As a result, compressed refrigerant gas is discharged into the discharge space DS defined in the head cover 9.

In the procedure in which the suction and discharge of refrigerant gas are repeated, a repetitive pressure pulsation occurs continuously in the suction muffler 10 and head cover 9. Such pressure pulsations, which exhibit phase differences, are propagated to each flow path defined in the suction muffler 10. As these pressure pulsations pass the second small-diameter tube 16, second reservoir S2, first small-diameter tube 15, and first reservoir S1, they are gradually attenuated, and finally dissipated. As a result, there are little pressure pulsations at the muffler inlet 11. Accordingly, the refrigerant gas can be smoothly introduced.

Meanwhile, noises generated during the suction of refrigerant gas are converted into heat energy in accordance with a diffusion and dissipation thereof occurring when they pass through the small-diameter tubes 15 and 16, and reservoirs S1 and S2, so that it is attenuated. In particular, noises of a specific frequency are attenuated by a helmholtz's effect obtained by the helmholtz resonator composed of the resonant aperture 17 of the second small-diameter tube 16 and the third reservoir S3.

However, the above mentioned conventional reciprocating compressor has problems because gas passages defined by the muffler inlet 11, the first and second small-diameter tubes 15 and 16, and the muffler outlet 12 are arranged in parallel together. That is, gas sucked into the muffler inlet 11 changes its flow direction after being struck against the second partition plate 14, and then introduced into the second reservoir S2 via the first small-diameter tube 15 after being struck against the side wall surface of the first reservoir S1. The sucked gas introduced into the second reservoir S2 changes its flow direction after being struck against the bottom surface of the second reservoir S2, and then sucked into the compression chamber of the cylinder 3 via the second small-diameter tube 16 and the muffler outlet 12. When the gas sucked at a high velocity is struck against the second partition plate 14 and the first and second reservoirs S1 and S2, flow pulsations of a high level are generated.

The level of impact resulting from the striking of the sucked gas may be reduced by increasing the distance between the muffler inlet 11 and the second partition plate 14, the width of the first reservoir S1, or the distance between the first small-diameter tube 15 and the second reservoir S2, thereby decreasing the velocity of the sucked gas. However, this method results in an increased compressor size because the size of the suction muffler 10 is increased. Where the distance between the muffler inlet 11 and the second partition plate 14, the width of the first reservoir S1, or the distance between the first small-diameter tube 15 and the second reservoir S2 is reduced to the problem involved in this method, an increase in the level of flow pulsations occurs, thereby resulting an increase in suction noises.

SUMMARY OF THE INVENTION

The present invention has been made in view of the above mentioned problems involved in the conventional suction muffler applied to a reciprocating compressor, and an object of the invention is to provide a suction muffler capable of attenuating flow pulsations generated due to a striking of refrigerant gas, sucked into the interior of the suction muffler during a gas sucking operation, against constructions arranged in the suction muffler while reducing the size of the suction muffler.

In accordance with the present invention, this object is accomplished by providing a suction muffler comprising a muffler inlet, a muffler outlet communicating with the muffler outlet, a plurality of reservoirs defined between the muffler inlet and the muffler outlet, and a plurality of small-diameter tubes adapted to allow the reservoirs to communicate sequentially with one another, further comprising: a vibration absorbing member installed on an inner wall surface of each of the reservoirs at a region where a flow of fluid sucked at a high velocity into the muffler inlet and forced to flow to the muffler outlet via the small-diameter tubes is struck against the inner wall surface, the vibration absorbing member serving to absorb vibrations generated due to pulsations of the fluid flow resulting from the striking of the fluid flow against the inner wall surface, thereby attenuating flow noises resulting from the vibrations.

In accordance with an embodiment of the present invention, the vibration absorbing member is provided with a plurality of wave interference grooves at a surface thereof, against which the fluid flow is struck, each of the wave interference grooves having a depth corresponding to ⅛ or more of a maximum displacement of the pulsations.

In accordance with another embodiment of the present invention, the vibration absorbing member is provided with a plurality of wave interference slits at a surface thereof, against which the fluid flow is struck, each of the wave interference slits having a depth corresponding to ⅛ or more of a maximum displacement of the flow pulsations.

Preferably, the vibration absorbing member is provided with a plurality of stepped protrusions at facing inner surfaces of each of the wave interference slits, the stepped protrusions at each of the facing inner surfaces being arranged in a continued fashion in a flowing direction of the fluid to prevent the fluid from flowing reversely due to the flow pulsations.

Preferably, the vibration absorbing member has an area extending radially from a center of an associated one of the muffler inlet and the small-diameter tubes facing the vibration absorbing member, the area having a width corresponding to 1.2 times or more a diameter of the associated muffler inlet or small-diameter tube when a straight distance between the associated muffler inlet or small-diameter tube and the inner wall surface, on which the vibration absorbing member is installed, is more than the diameter of the associated muffler inlet or small-diameter tube while having a width corresponding to 2.4 times or more the diameter of the associated muffler inlet or small-diameter tube when the straight distance is not more than the diameter of the associated muffler inlet or small-diameter tube.

DESCRIPTION OF THE PREFERRED EMBODIMENTS

Hereinafter, a suction muffler according to the present invention will be described in detail, with reference to the annexed drawings illustrating an embodiment of the present invention.

Figure 1:
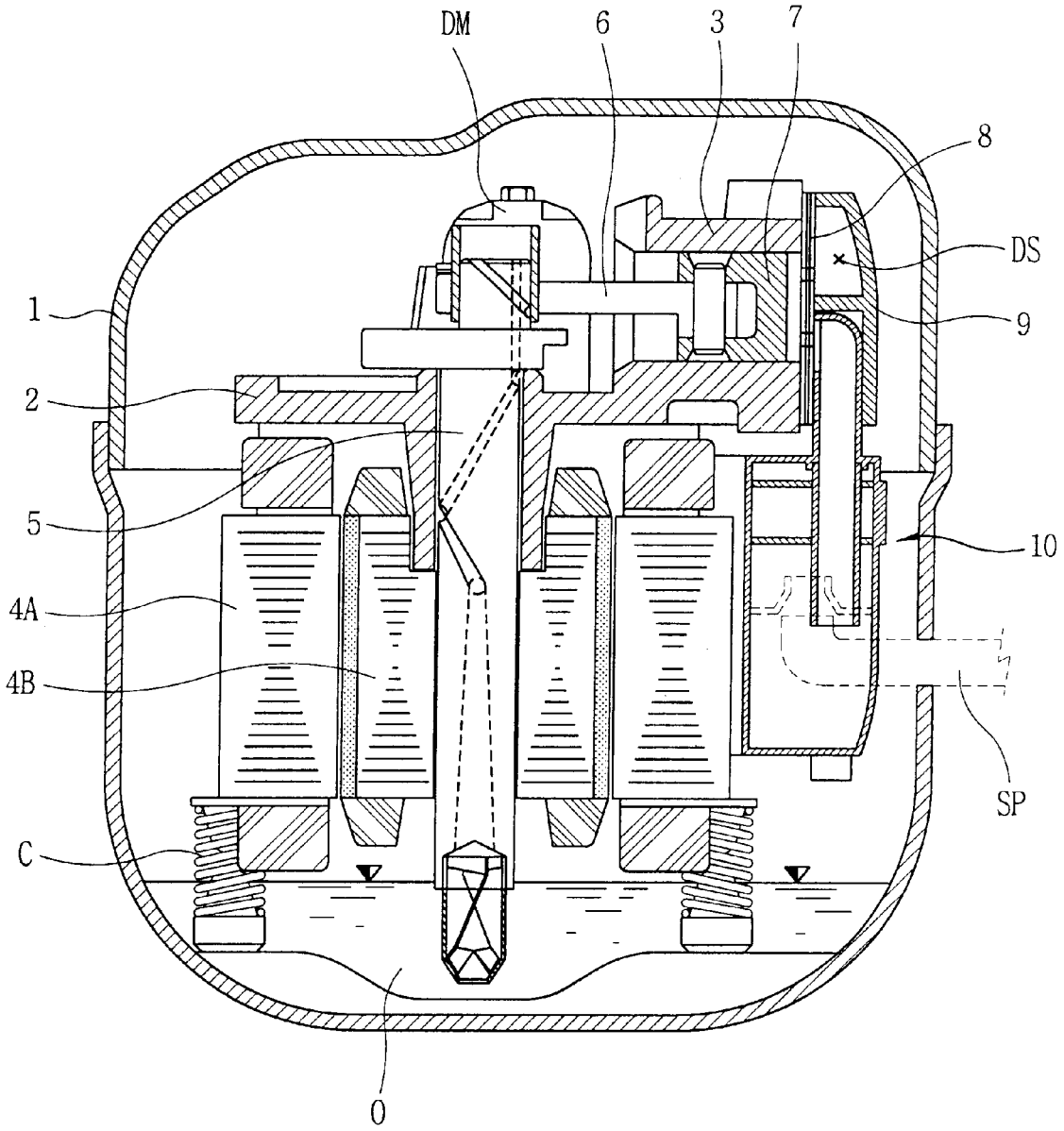
FIG. 1 BACKGROUND ART
FIG. 1 is a sectional view illustrating an example of a conventional reciprocating compressor.
Figure 2:
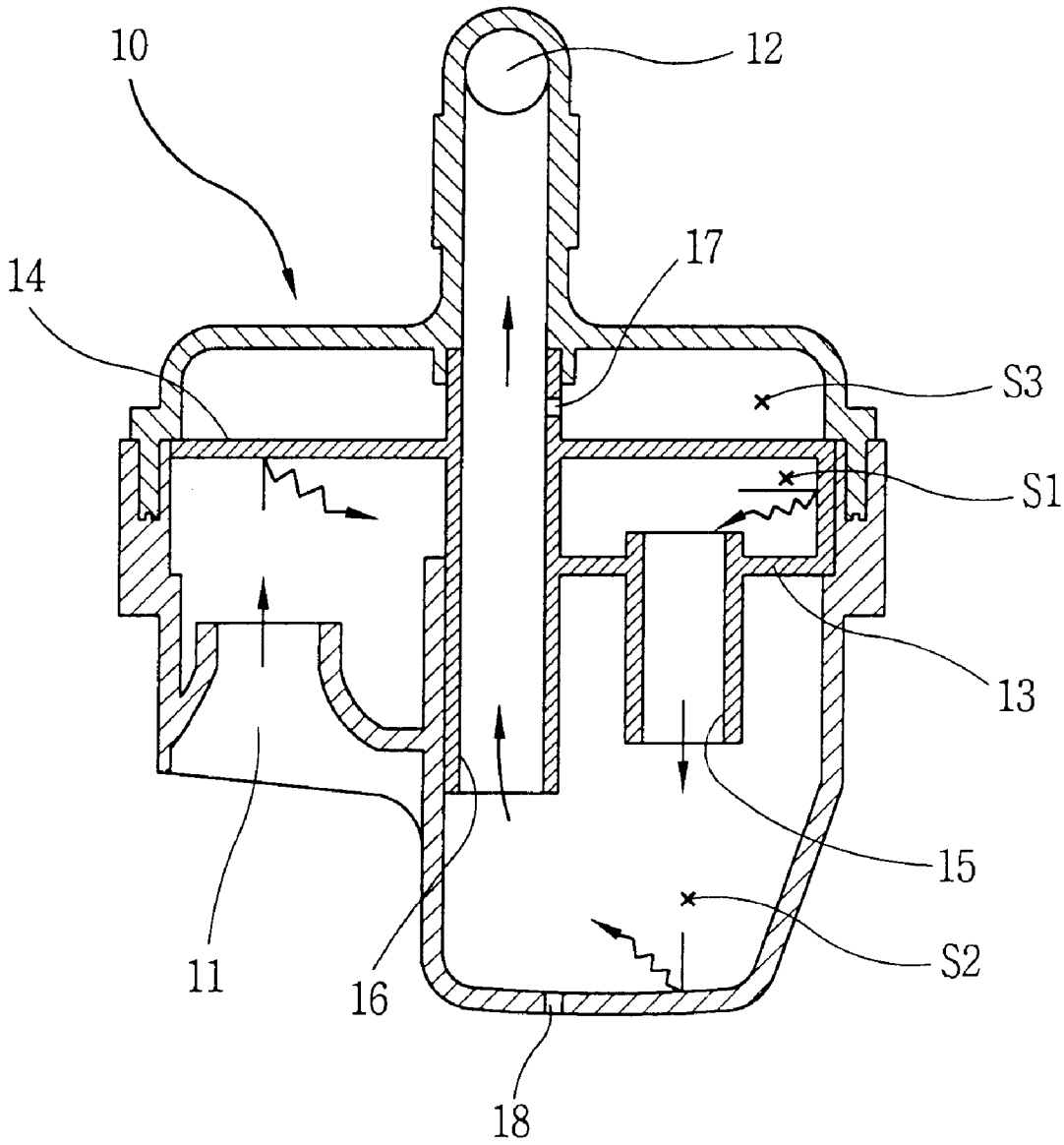
FIG. 2 BACKGROUND ART
FIG. 2 is a sectional view illustrating an example of a suction muffler mounted to a suction section of the conventional reciprocating compressor.
Figure 3:
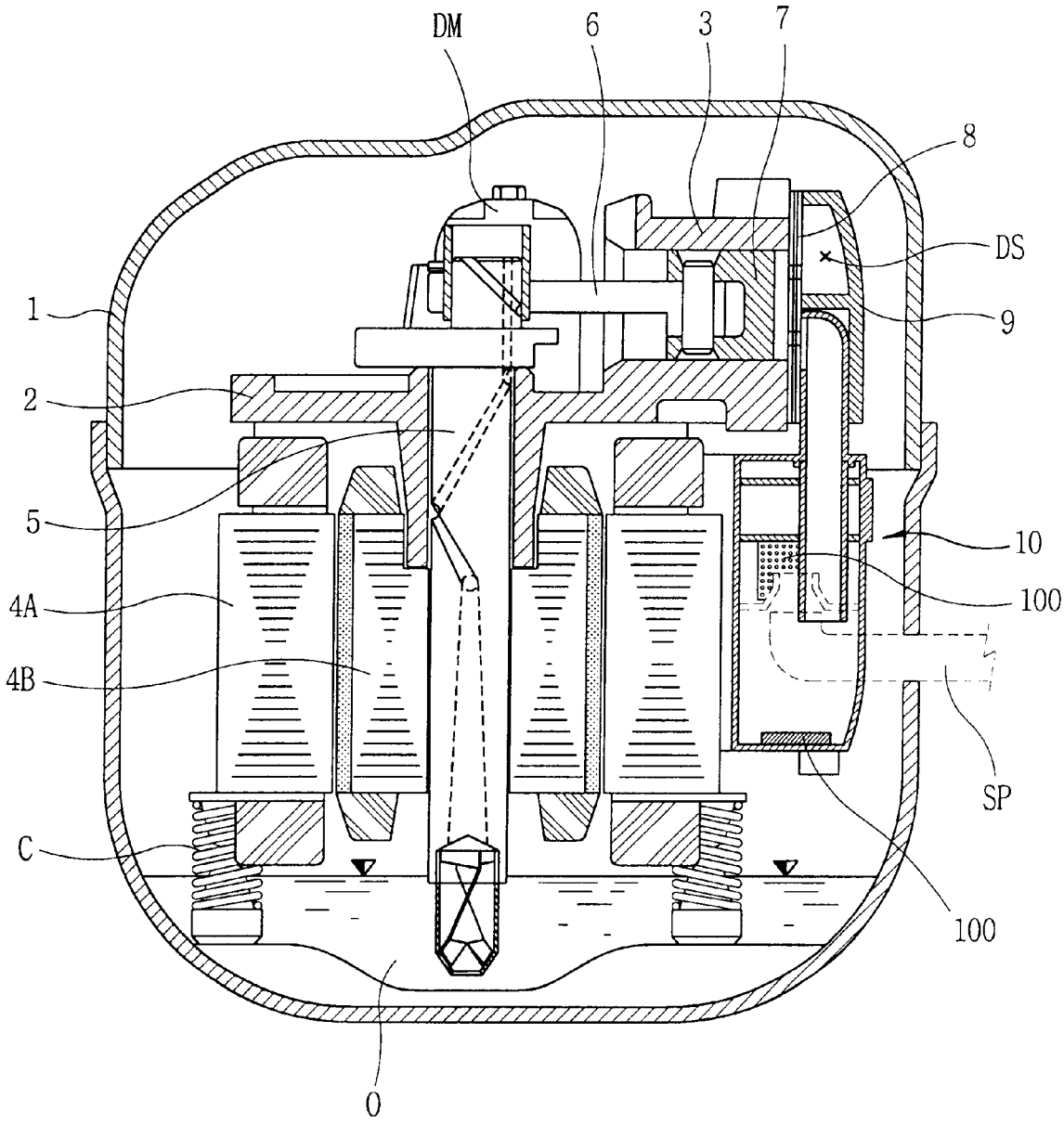
FIG. 3 is a sectional view illustrating an example of a reciprocating compressor provided with a suction muffler according to the present invention.
Figure 4:
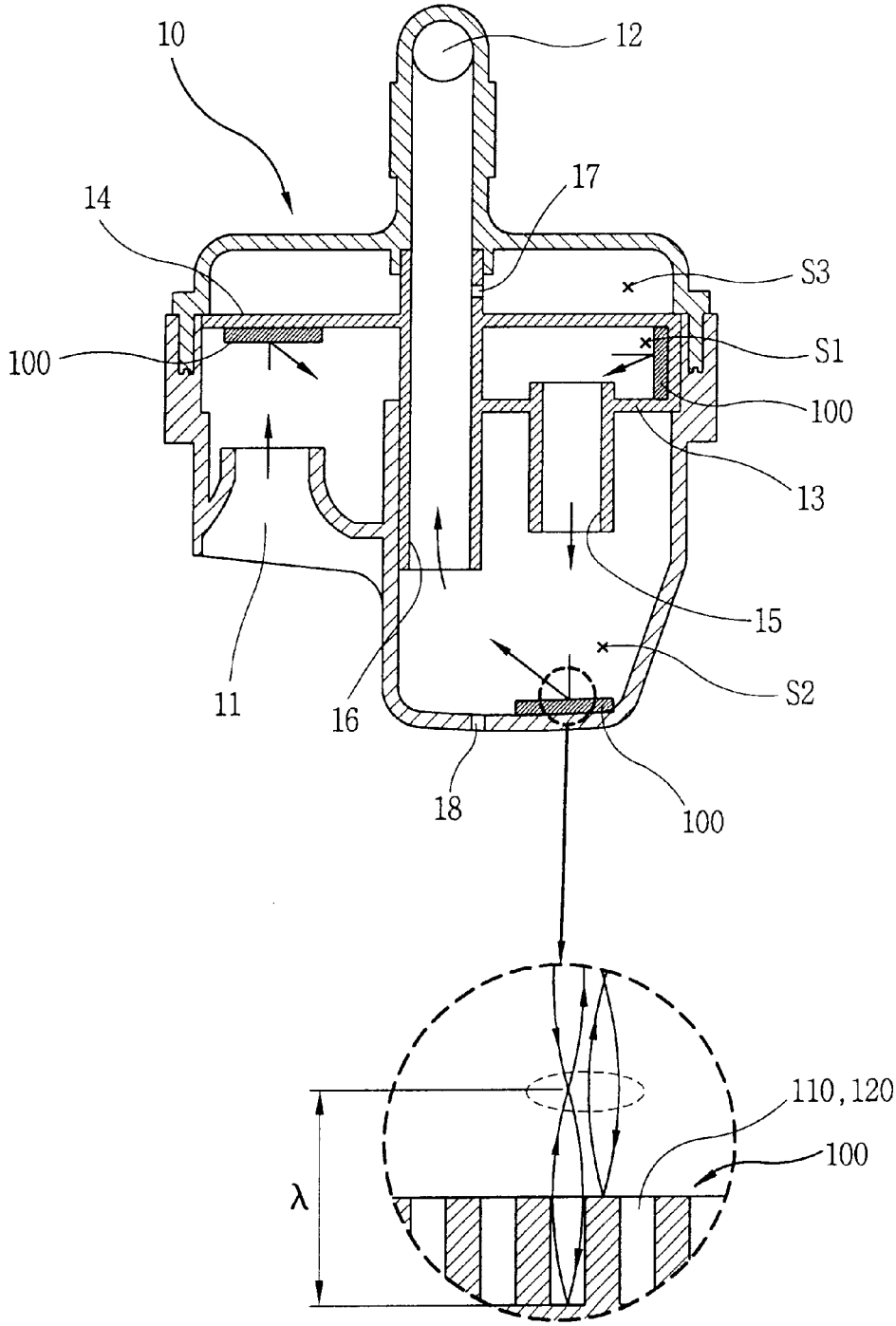
FIG. 4 is a sectional view illustrating the suction muffler of the present invention.
Figure 5:
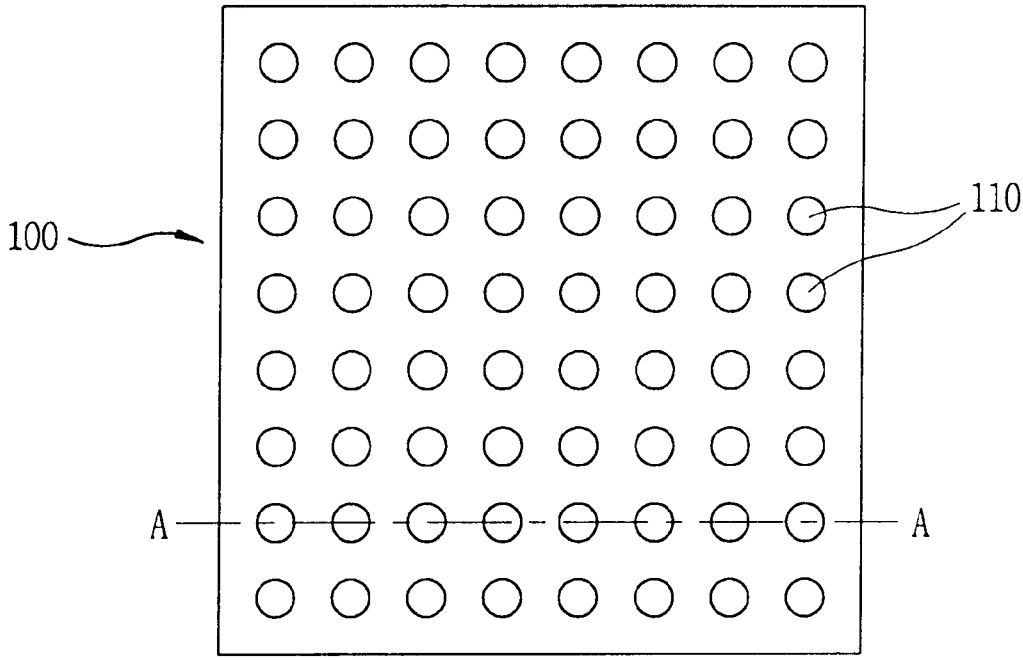
FIG. 5 is a plan view illustrating a vibration absorbing member included in the suction muffler in accordance with an embodiment of the present invention.
Figure 6:
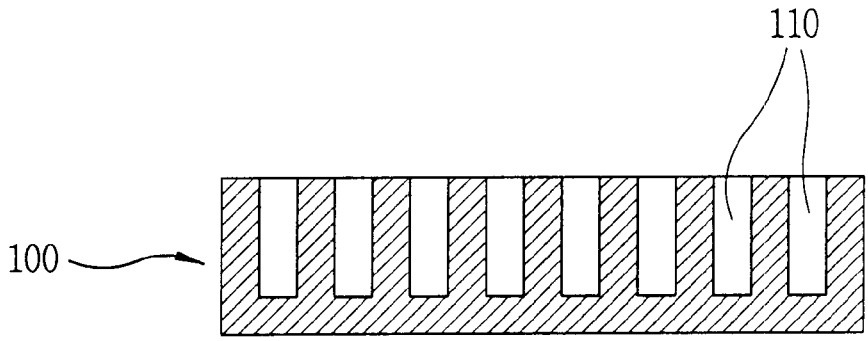
FIG. 6 is a cross-sectional view taken along the line A—A of FIG. 5.
Figure 7:
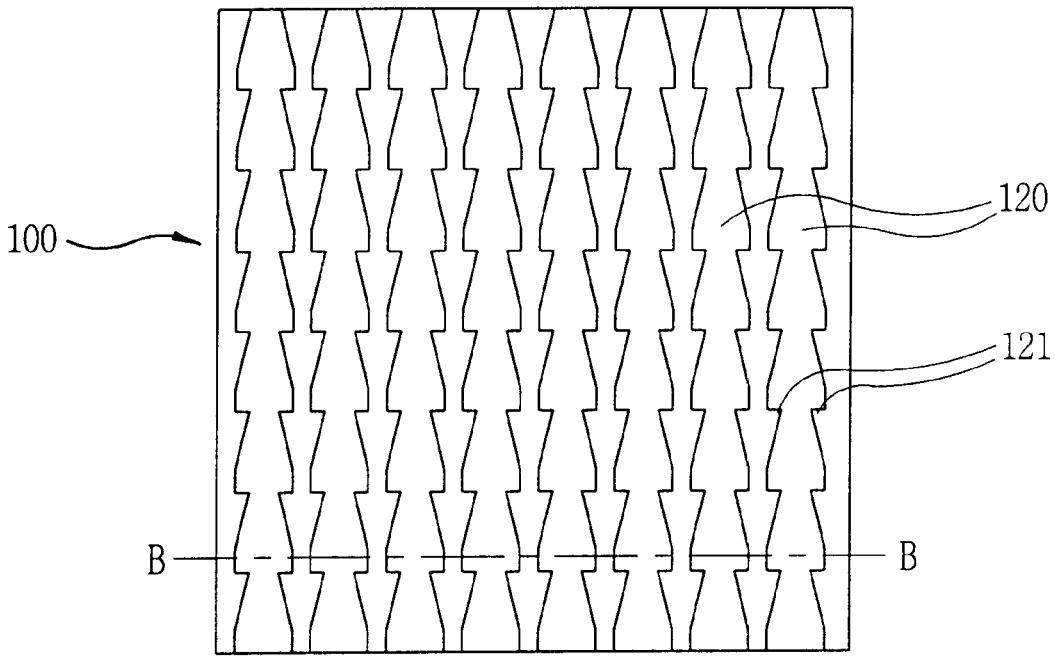
FIG. 7 is a plan view illustrating a vibration absorbing member included in the suction muffler in accordance with another embodiment of the present invention.
Figure 8:
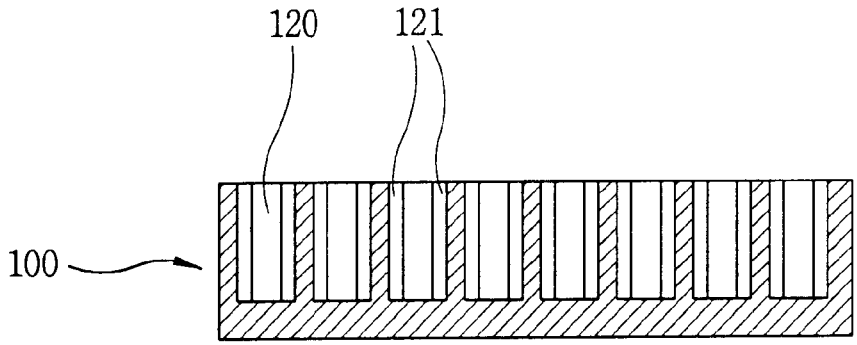
FIG. 8 is a cross-sectional view taken along the line B—B of FIG. 7.
Figure 9:
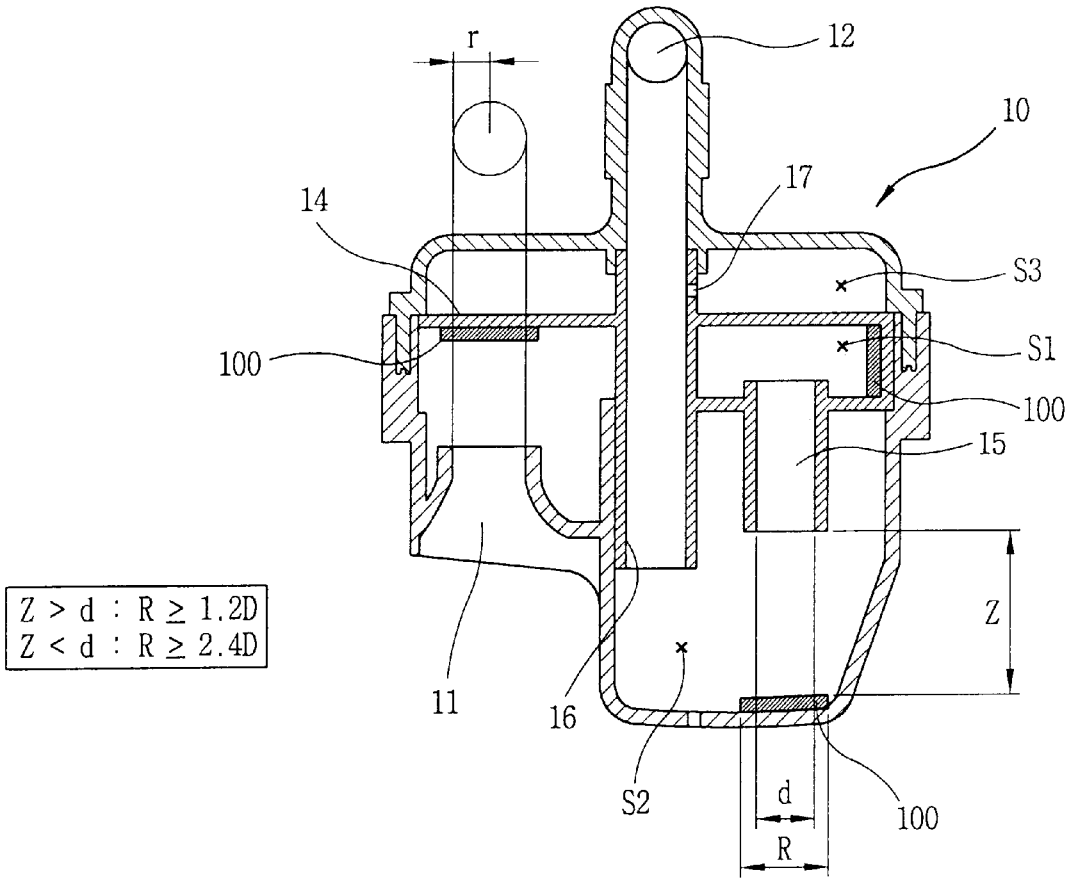
FIG. 9 is a sectional view illustrating the dimensions of the vibration absorbing member included in the suction muffler of the present invention.

FIG. 3 is a sectional view illustrating an example of a reciprocating compressor provided with a suction muffler according to the present invention. FIG. 4 is a sectional view illustrating the suction muffler of the present invention. FIG. 5 is a plan view illustrating a vibration absorbing member included in the suction muffler of the present invention while having a structure according to an embodiment of the present invention. FIG. 6 is a cross-sectional view taken along the line A—A of FIG. 5. FIG. 7 is a plan view illustrating the vibration absorbing member included in the suction muffler of the present invention while having a structure modified from that of FIG. 5 in accordance with another embodiment of the present invention. FIG. 8 is a cross-sectional view taken along the line B—B of FIG. 7. FIG. 9 is a sectional view illustrating the dimensions of the vibration absorbing member included in the suction muffler of the present invention. In these drawings, elements respectively corresponding to those in FIGS. 1 and 2 are denoted by the same reference numerals.

Referring to the drawings as above, in particular, FIG. 3, a reciprocating compressor provided with the suction muffler of the present invention is illustrated. As shown in FIG. 3, the reciprocating compressor includes an electric motor mechanism fixedly mounted in a casing 1 and adapted to generate a drive force, and a compression mechanism connected to the electric motor mechanism by a drive shaft 5 and adapted to conduct sucking, compressing and discharging operations for refrigerant gas.

As shown in FIG. 3, the compression mechanism includes a frame 2 fixedly mounted to the casing 1 above the electric motor mechanism in the interior of the casing 1 to extend laterally, a cylinder 3 fixedly mounted to a portion of the frame 2, and a drive shaft 5 extending through a central portion of the frame 2 while being firmly fitted in a rotor 4B included in the electric motor mechanism. The drive shaft 5 is provided at an upper end thereof with an eccentric portion. The compression mechanism also includes a connecting rod 6 coupled at one end thereof to the eccentric portion of the drive shaft 5, a piston 7 connected to the other end of the connecting rod 6 and received into the cylinder 3 at one end of the cylinder 3, a valve assembly 8 coupled at one end thereof to the other end of the cylinder 3, and a head cover 9 coupled to the other end of the valve assembly 8. The compression mechanism further includes a suction muffler 10 coupled to the valve assembly 8 in such a fashion that it communicates with a suction section of the valve assembly 8, and a discharge muffler DM mounted to the cylinder 3 in such a fashion that it communicates with a discharge section of the valve assembly 8.

As shown in FIG. 4, the suction muffler 10 includes a muffler inlet 11 communicating directly with a refrigerant suction line SP extending through the casing 1 or arranged in the interior of the casing 1, and a muffler outlet 12 communicating with the suction section of the valve assembly 8 to allow refrigerant gas introduced into the muffler inlet 11 to be guided to a compression chamber defined in the cylinder 3. The suction muffler 10 also includes a pair of partition plates, that is, a first partition plate 13 and a second partition plate 14, adapted to partition the inner volume of the suction muffler 10 defined between the muffler inlet 11 and muffler outlet 12 into three reservoirs in the form of expansion chambers, that is, a first reservoir S1, a second reservoir S2, and a third reservoir S3. The suction muffler 10 further includes a first small-diameter tube 15 extending vertically through the first partition plate 13 and serving to allow the first and second reservoirs S1 and S2 to communicate with each other, a second small-diameter tube 16 extending through the first and second partition plates 13 and 14 and serving to allow the second reservoir S2 to communicate directly with the muffler outlet 12, and a resonant aperture 17 formed at an intermediate wall portion of the second small-diameter tube 16 arranged in the third reservoir S3 and adapted to allow the third reservoir S3 to communicate with the muffler outlet 12 so that it constitutes a helmholtz resonator, together with the third reservoir S3.

Vibration absorbing members 100 are mounted to a portion of the bottom surface of the second partition plate 14 facing the muffler inlet 11, the wall surface of the first reservoir S1, and a portion of the bottom surface of the second reservoir S2 facing to the outlet end of the first small-diameter tube 15, respectively. These vibration absorbing members 100 serve to absorb vibrations of pulsating flows.

As shown in FIGS. 5 and 6, each vibration absorbing member 100 is provided at a gas strike surface thereof with a plurality of wave interference grooves 110 each having a depth corresponding to ⅛ or more of a maximum displacement of pulsating flows. Alternatively, each vibration absorbing member 100 may be provided at the gas strike surface thereof with a plurality of wave interference slits 120 each having a depth corresponding to ⅛ or more of the maximum displacement of pulsating flows, as shown in FIGS. 7 and 8.

In the case of the vibration absorbing member 100 having the wave interference slits 120, it is desirable for each wave interference slit 120 to also have a plurality of stepped protrusions 121 at facing inner surfaces thereof. The stepped protrusions are arranged in a continued fashion in the flowing direction of the refrigerant gas to prevent the refrigerant gas from flowing reversely due to flow pulsations.

As shown in FIG. 9, the width of each vibration absorbing member 100 is determined, based on the ratio between a vertical distance z defined between the gas strike surface of the vibration absorbing member 100 and an associated one of the muffler inlet 11 and first small-diameter tube 15 facing the gas strike surface of the vibration absorbing member 100 and a diameter d of the associated muffler inlet 11 or first small-diameter tube 15. Where the vertical distance z is more than the diameter d ($z>d$), the vibration absorbing member 100 preferably has a diameter R corresponding to 1.2 times the diameter d of the associated muffler inlet 11 or first small-diameter tube 15. On the other hand, where the vertical distance z is not more than the diameter d ($z \leqq d$), the vibration absorbing member 100 preferably has a diameter R corresponding to 2.4 times the diameter d of the associated muffler inlet 11 or first small-diameter tube 15. In FIGS. 1 and 2, the reference numeral or character 4A denotes a stator, 18 an oil discharge port, C a support spring, 0 an oil feeder, and SP a suction tube. The general operation of the reciprocating compressor installed with the suction muffler of the present invention is the same as those of conventional cases.

When the rotor 4B is rotated by a mutual electromagnetic force generated between the stator 4A and the rotor 4B in response to electric power applied to the electric motor mechanism, the drive shaft 5 rotates along with the rotor 4B. The rotation of the drive shaft 5 is converted into straight reciprocating movements by the connecting rod 6 coupled to the eccentric portion of the drive shaft 5. The reciprocating movements are transmitted to the piston 7 which, in turn, reciprocates in the interior of the cylinder 3 to suck and compress refrigerant gas and to discharge the compressed refrigerant gas. Pressure pulsations and noises, which may be generated during the above mentioned operations of the piston 7, flow in a direction opposite to the flowing direction of the refrigerant gas so that they are attenuated by the suction muffler 10.

During a suction stroke of the piston 7, gas sucked into the muffler inlet 11 at a high velocity is struck against the bottom surface of the second partition plate 14 defining the first reservoir S1 and facing the outlet end of the muffler inlet 11, and then changes its flow direction along the second partition plate 14, so that it flows toward the first small-diameter tube 15. Subsequently, the sucked gas is struck against the inner wall surface of the first reservoir S1, and then introduced into the second reservoir S2 via the first small-diameter tube 15. As the sucked gas is introduced into the second reservoir S2, it is struck against the bottom surface of the second reservoir S2 facing the outlet end of the first small-diameter tube 15, and then guided toward the muffler outlet 12 via the second small-diameter tube 16. Although pressure pulsations are generated as the sucked gas is struck against various sections of the suction muffler during the flowing procedure thereof, thereby generating noise pulsations, these noise pulsations are attenuated by the vibration absorbing members 100 installed at those gas strike sections and adapted to offset different wavelengths of flow pulsations.

The operation of each vibration absorbing member 100 will now be described in detail.

Where a pulsating flow generated in the reciprocating compressor according to the illustrated embodiment of the present invention has a maximum velocity of 12 m/s at 3,600 rpm, it has a frequency of 60 Hz. Under this condition, the displacement of the pulsating flow caused by one pulsation corresponds to about 64 mm, as derived in accordance with the following integral equation:

$$S_{tot} = V_{\max}\int_0^{\frac{T}{2}} \sin 12\pi t dt = 12\int_0^{\frac{1}{120}} \sin 12\pi t dt = 0.0637 \quad \text{[Equation]}$$

In order to effectively attenuate pulsations based on phase differences of waves, it is necessary to space those waves apart from a wall, on which the waves are struck and reflected, by a distance of $\lambda/8$ or more. This is because the level of waves struck against and reflected from a wall is insufficient in the case in which those waves are spaced apart from the wall by a distance of less than $\lambda/8$. Taking into consideration this fact, the wave interference grooves 110 or wave interference slits 120 provided at each vibration absorbing member 100 has a depth of 8 mm or more in the above mentioned case in accordance with the present invention. Under this condition, waves struck against the inner surfaces of the wave interference grooves 110 or wave interference slits 120 interfere with waves reflected from the upper surface of the associated vibration absorbing member 100 by virtue of a phase difference therebetween, so that they are offset by each other. Thus, a reduction in noises is achieved.

Figure 10:
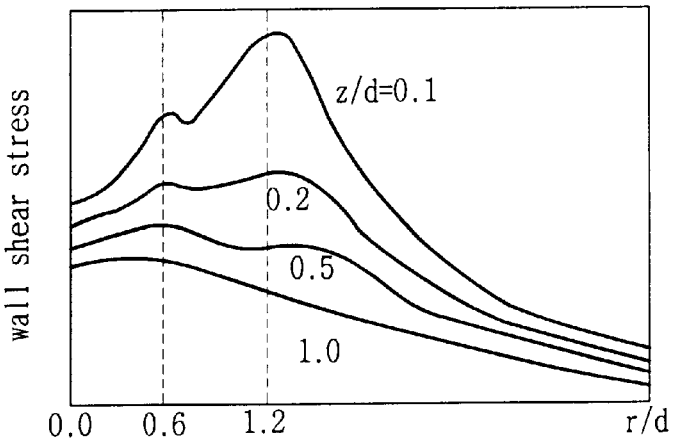
FIG. 10 is a graph depicting a wall shear stress distribution exhibited when a circular jet flow is struck against a wall.

In addition to the depth of the wave interference grooves 110 or wave interference slits 120, the noise attenuating effect obtained by the vibration absorbing member 100 has intimate relations with the area of the vibration absorbing member 100 and the diameter of the tube associated with the vibration absorbing member 100. That is, the vibration absorbing member 100 should have a width capable of allowing the vibration absorbing member 100 to extend completely over the sphere of influence of striking flows. FIG. 10 is a graph depicting a wall shear stress distribution exhibited when a circular jet flow is struck against a wall.

Based on the results of FIG. 10, it can be found that where the distance z from the outlet end of the muffler inlet 11 or first small-diameter tube 15 to a wall, against which refrigerant gas emerging from the muffler inlet 11 or first small-diameter tube 15 is struck, is not more than the diameter d of the muffler inlet 11 or first small-diameter tube 15, the influence of striking flows is exerted on a portion of the wall extending radially from the center of the muffler inlet 11 or first small-diameter 15 to a radius r corresponding to 1.2 times the diameter d of the muffler inlet 11 or first small-diameter tube 15. In this case, accordingly, the vibration absorbing member 100 installed on the wall should have a diameter R corresponding to 2.4 times the diameter d of the associated muffler inlet 11 or first small-diameter tube 15. It can also be found that the distance z from the outlet end of the muffler inlet 11 or first small-diameter tube 15 to the gas-struck wall is more than the diameter d of the muffler inlet 11 or first small-diameter tube 15, the influence of striking flows is exerted on a portion of the wall extending radially from the center of the muffler inlet 11 or first small-diameter 15 to radius r corresponding to 0.6 times the diameter d of the muffler inlet 11 or first small-diameter tube 15. In this case, accordingly, the vibration absorbing member 100 installed on the wall should have a diameter R corresponding to 1.2 times the diameter d of the associated muffler inlet 11 or first small-diameter tube 15.

Where the radius or width of the vibration absorbing member 100 is considerably larger than the diameter of the associated muffler inlet 11 or first small-diameter tube 15 by 2.4 times or more, it is possible to correspondingly reduce the distance between the outlet end of the muffler inlet 11 or first small-diameter tube 15 and the associated gas-struck wall. Accordingly, the size of the suction muffler 10 can be considerably reduced.

Although the present invention has been described in association with the muffler according to the illustrated embodiment, it may be applied to a variety of mufflers involving flow pulsations resulting from a striking of refrigerant gas. Also, the present invention can be applied not only to suction mufflers, but also to discharge mufflers.

As apparent from the above description, the present invention provides a suction muffler including vibration absorbing members capable of absorbing vibrations of refrigerant gas flows, sucked at a high velocity into the interior of the suction muffler during a gas sucking operation, applied to inner wall surfaces of reservoirs defined in the suction muffler due to a striking of those refrigerant gas flows against those inner wall surfaces, thereby attenuating flow pulsations generated due to the striking of refrigerant gas flows. By virtue of such a configuration, the suction muffler obtains an effect capable of offsetting noises generated when refrigerant gas flows are struck against inner constructions of the suction muffler.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A suction muffler, comprising:

a muffler inlet;

a muffler outlet communicating with the muffler inlet;

a plurality of reservoirs defined between the muffler inlet and the muffler outlet;

at least one small-diameter tube adapted to allow the reservoirs to communicate sequentially with one another; and a vibration absorbing member installed on an inner wall surface of at least one of the reservoirs at a region where a flow of fluid sucked at a high velocity into the muffler inlet and forced to flow to the muffler outlet via the small-diameter tube is struck against the inner wall surface, the vibration absorbing member including a plurality of bottomed indentations extending therein, the vibration absorbing member serving to absorb vibrations generated due to pulsations of the fluid flow resulting from the striking of the fluid flow against the inner wall surface, thereby attenuating flow noises resulting from the vibrations.

2. A suction muffler comprising a muffler inlet, a muffler outlet communicating with the muffler inlet, a plurality of reservoirs defined between the muffler inlet and the muffler outlet, and a plurality of small-diameter tubes adapted to allow the reservoirs to communicate sequentially with one another, further comprising:

a vibration absorbing member installed on an inner wall surface of each of the reservoirs at a region where a flow of fluid sucked at a high velocity into the muffler inlet and forced to flow to the muffler outlet via the small-diameter tubes is struck against the inner wall surface, the vibration absorbing member serving to absorb vibrations generated due to pulsations of the fluid flow resulting from the striking of the fluid flow against the inner wall surface, thereby attenuating flow noises resulting from the vibrations, wherein the vibration absorbing member is provided with a plurality of wave interference grooves at a surface thereof, against which the fluid flow is struck, each of the wave interference grooves having a depth corresponding to ⅛ or more of a maximum displacement of the pulsations.

3. A suction muffler comprising a muffler inlet, a muffler outlet communicating with the muffler inlet, a plurality of reservoirs defined between the muffler inlet and the muffler outlet, and a plurality of small-diameter tubes adapted to allow the reservoirs to communicate sequentially with one another, further comprising:

a vibration absorbing member installed on an inner wall surface of each of the reservoirs at a region where a flow of fluid sucked at a high velocity into the muffler inlet and forced to flow to the muffler outlet via the small-diameter tubes is struck against the inner wall surface, the vibration absorbing member serving to absorb vibrations generated due to pulsations of the fluid flow resulting from the striking of the fluid flow against the inner wall surface, thereby attenuating flow noises resulting from the vibrations, wherein the vibration absorbing member is provided with a plurality of wave interference slits at a surface thereof, against which the fluid flow is struck, each of the wave interference slits having a depth corresponding to ⅛ or more of a maximum displacement of the flow pulsations.

4. The suction muffler according to claim 3, wherein the vibration absorbing member is provided with a plurality of stepped protrusions at facing inner surfaces of each of the wave interference slits, the stepped protrusions at each of the facing inner surfaces being arranged in a continued fashion in a flowing direction of the fluid to prevent the fluid from flowing reversely due to the flow pulsations.

5. A suction muffler comprising a muffler inlet, a muffler outlet communicating with the muffler inlet, a plurality of reservoirs defined between the muffler inlet and the muffler outlet, and a plurality of small-diameter tubes adapted to allow the reservoirs to communicate sequentially with one another, further comprising:

a vibration absorbing member installed on an inner wall surface of each of the reservoirs at a region where a flow of fluid sucked at a high velocity into the muffler inlet and forced to flow to the muffler outlet via the small-diameter tubes is struck against the inner wall surface, the vibration absorbing member serving to absorb vibrations generated due to pulsations of the fluid flow resulting from the striking of the fluid flow against the inner wall surface, thereby attenuating flow noises resulting from the vibrations, wherein the vibration absorbing member has an area extending radially from a center of an associated one of the muffler inlet and the small-diameter tubes facing the vibration absorbing member, the area having a width corresponding to 1.2 times or more a diameter of the associated muffler inlet or small-diameter tube when a straight distance between the associated muffler inlet or small-diameter tube and the inner wall surface, on which the vibration absorbing member is installed, is more than the diameter of the associated muffler inlet or small-diameter tube while having a width corresponding to 2.4 times or more the diameter of the associated muffler inlet or small-diameter tube when the straight distance is not more than the diameter of the associated muffler inlet or small-diameter tube.

6. The suction muffler according to claim 1, wherein the bottomed indentations comprise wave interference grooves.

7. The suction muffler according to claim 1, wherein the bottomed indentations comprise wave interference slits.

* * * * *